US008525635B2

(12) United States Patent
Navarro et al.

(10) Patent No.: US 8,525,635 B2
(45) Date of Patent: Sep. 3, 2013

(54) OXYGEN-BARRIER PACKAGED SURFACE MOUNT DEVICE

(75) Inventors: Luis A. Navarro, San Carlos, CA (US); Josh H. Golden, Santa Cruz, CA (US); Martyn A. Matthiesen, Fremont, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 405 days.

(21) Appl. No.: 12/460,349

(22) Filed: Jul. 17, 2009

(65) Prior Publication Data

US 2011/0014415 A1 Jan. 20, 2011

(51) Int. Cl.
*H01C 7/13* (2006.01)

(52) U.S. Cl.
USPC ..... 338/22 R

(58) Field of Classification Search
USPC ..... 338/22 R
See application file for complete search history.

(56) References Cited

U.S. PATENT DOCUMENTS

| | | | | |
|---|---|---|---|---|
| 3,420,914 | A | 1/1969 | May | |
| 3,637,618 | A | 1/1972 | May | |
| 3,853,962 | A | 12/1974 | Gander | |
| 4,315,237 | A * | 2/1982 | Middleman et al. | 338/22 R |
| 4,412,048 | A | 10/1983 | Dixon et al. | |
| 4,636,431 | A | 1/1987 | DeBergalis | |
| 4,786,888 | A * | 11/1988 | Yoneda et al. | 338/22 R |
| 5,300,541 | A | 4/1994 | Nugent et al. | |
| 5,840,825 | A | 11/1998 | Carlblom et al. | |
| 5,959,846 | A * | 9/1999 | Noguchi et al. | 361/782 |
| 6,023,403 | A * | 2/2000 | McGuire et al. | 361/106 |
| 6,312,828 | B1 | 11/2001 | Akao | |
| 6,555,187 | B1 | 4/2003 | Kitamura | |
| 7,371,459 | B2 * | 5/2008 | Galla | 428/414 |
| 2002/0153325 | A1 | 10/2002 | Martin | |
| 2005/0171229 | A1 | 8/2005 | Mirone et al. | |
| 2006/0223937 | A1 | 10/2006 | Herr et al. | |
| 2010/0120993 | A1 | 5/2010 | Chatterjee et al. | |
| 2010/0182121 | A1 * | 7/2010 | Li et al. | 338/22 R |
| 2011/0014415 | A1 * | 1/2011 | Navarro et al. | 428/76 |
| 2011/0241818 | A1 * | 10/2011 | Sha et al. | 338/22 R |

FOREIGN PATENT DOCUMENTS

| | | | |
|---|---|---|---|
| CA | 1127320 | A1 | 7/1982 |
| CN | 1744792 | A | 3/2006 |
| CN | 101221846 | A | 7/2008 |
| CN | 101271751 | A | 9/2008 |
| CN | 101335125 | A | 12/2008 |
| EP | 1350822 | A1 | 10/2003 |

(Continued)

OTHER PUBLICATIONS

""NEOPOL" & "U-PiCA" Epoxyacrylate & Urethaneacrylate for UV Curing", Japan U-PiCA Company, Ltd. bulletin, Nov. 2008.

(Continued)

*Primary Examiner* — James Harvey

(57) ABSTRACT

A method for producing a surface mount device includes providing a plurality of layers including a B-staged top layer and bottom layer, and a C-staged middle layer with an opening. A core device is inserted into the openings, and then the top and bottom layers are placed over and under, respectively, the middle layer. The layers are cured until the layers become C-staged. The core device is substantially surrounded by an oxygen-barrier material with an oxygen permeability of less than approximately 0.4 cm3·mm/m2·atm·day.

17 Claims, 9 Drawing Sheets

(56) References Cited

FOREIGN PATENT DOCUMENTS

| | | | |
|---|---|---|---|
| EP | 1632960 | A1 | 3/2006 |
| EP | 1992654 | A1 | 11/2008 |
| JP | 2005-154386 | A | 6/2005 |
| WO | WO-93/07068 | A1 | 4/1993 |
| WO | WO-01/60701 | A2 | 8/2001 |
| WO | WO-2006/107748 | A1 | 10/2006 |
| WO | WO-2007/111606 | A1 | 10/2007 |
| WO | WO-2007/114822 | A1 | 10/2007 |

OTHER PUBLICATIONS

"Basics of Barriers—1", MOCON 2007 Internet Seminar, Oct. 10, 2007.
"Dow Liquid Epoxy Resins", Dow Chemical brochure, pp. 1-44, Jan. 1999.
David Bednar, "New Halogen-Free Materials: Their Time Has Finally Arrived", circuitree.com, pp. 26-29, Sep. 2008.
David W. Brooks, "Barrier Materials and Technology", *PET Packaging Technology*, pp. 98-115, Mar. 21, 2002.
ERISYS™ GA-240 Tetraglycidyl meta-Xylenediamine Technical Bulletin, CVC Thermoset Specialties, Nov. 24, 2008.
ERISYS™ RDGE H Resorcinol Diglycidyl Ether Technical Bulletin, CVC Thermoset Specialties, Aug. 21, 2008.
International Search Report for International Application No. PCT/US2010/002004, mailed Feb. 10, 2011.
International Search Report for International Application No. PCT/US2010/002005, mailed Nov. 29, 2010.
Kiichiro Seki, "Amine Epoxy Resin Curing Agent Offers Versatility", originally printed in Modern Paint and Coatings, pp. 36-40, Mar. 1995.
L.S. Penn & H. Wang, "Epoxy Resins", *Handbook of Composites*, S.T. Peters, ed., pp. 48-74, 1998.
M.H. Klopffer & B. Flaconneche, "Transport Propertisof Gases in polymers: Bibliographic Review", Oil & Gas Science and Technology, Rev. IFP, vol. 56, No. 3, pp. 223-244, 2001.
Morris Salame, "Structure/Property Relationships of High Barrier Polymers Relevant to Food & Beverage Packaging", First International Conference on New Innovations in Packaging Technologies and Markets, pp. 233-259, Nov. 1983.
Osamu Hara, "Curing Agents for Epoxy Resin", ThreeBond Technical News, vol. 32, Dec. 20, 1990.
R. Bruce Prime, "An Introduction to Thermosets", www.primethermosets.com, (link: introtothermosets.pdf), pp. 1-8, printed Mar. 5, 2012.
Raj B. Durairaj, "Resorcinol Additives for Packaging Extend Product Life for Food and Drink", Plastics Additives and Compounding, pp. 30-34, Oct. 1999.
Tetrad-X N,N,N',N'-tetraglycidyl-m-xylenediamine datasheet, Mitsubishi Gas Chemical Company, Inc., undated.
First Office Action from the State Intellectual Property Office of People's Republic of China for Chinese Application No. 201080031875.8, dated Jan. 29, 2013.

* cited by examiner

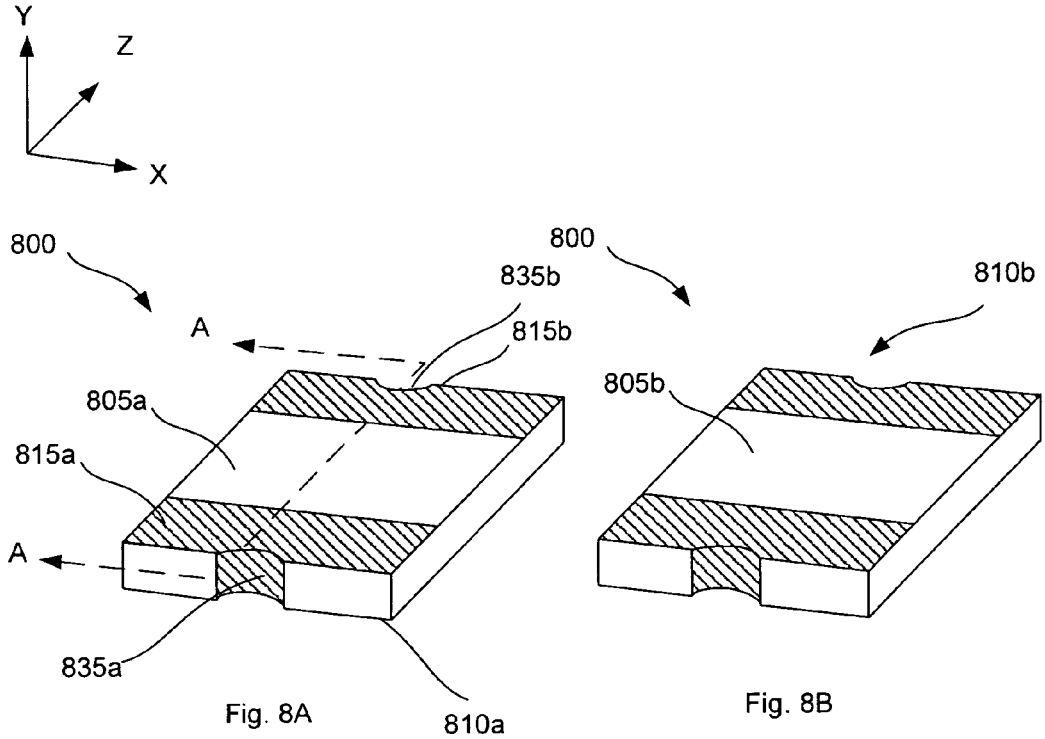
Fig. 8A
Fig. 8B
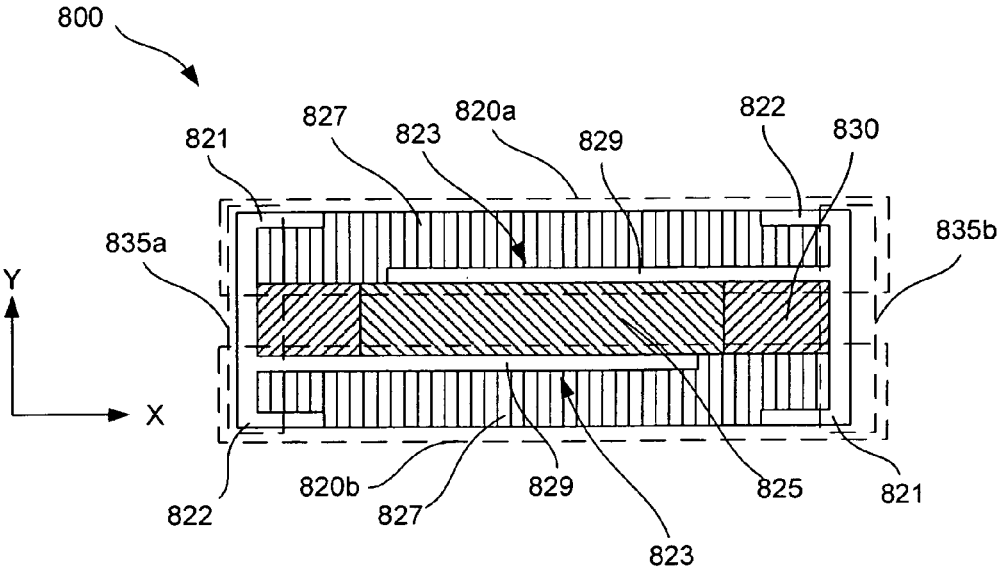
Fig. 8C

OXYGEN-BARRIER PACKAGED SURFACE MOUNT DEVICE

BACKGROUND

I. Field

The present invention relates generally to electronic circuitry. More specifically, the present invention relates to an oxygen-barrier packaged surface mount device.

II. Background Details

Surface mount devices (SMDs) are utilized in electronic circuits because of their small size. Generally, SMDs comprise a core device embedded within a housing material, such as plastic or epoxy. For example, a core device with resistive properties may be embedded in the housing material to produce a surface mount resistor.

One disadvantage with existing SMDs is that the materials utilized to encapsulate the core device tend to allow oxygen to permeate into the core device itself. This could be adverse for certain core devices. For example, the resistance of a positive-temperature-coefficient core device tends to increase over time if oxygen is allowed to enter the core device. In some cases, the base resistance may increase by a factor of five (5), which may take the core device out of spec.

SUMMARY

In one aspect, a method for producing a surface mount device includes providing a plurality of layers including a first layer that is B-staged and a second layer that defines an opening for receiving a core device. A core device may be inserted into the opening defined by the second layer. Then the second layer and the core device may be covered by the first layer that is B-staged. The first layer and second layer are then cured until the first layer that is B-staged becomes C-staged. The core device is substantially surrounded by an oxygen-barrier material with an oxygen permeability of less than approximately 0.4 cm3·mm/m2·atm·day (1 cm3·mil/100 in2·atm·day).

In a second aspect, a method for producing a surface mount device includes providing a substrate layer. The substrate layer includes a first and second conductive contact pad. A core device is fastened to the first contact pad such that a bottom conductive surface of the core device is in electrical contact with the first contact pad. A conductive clip is fastened over a top surface of the core device and the second contact pad to provide an electrical path from the top surface of the core device to the second pad. An A-staged material is injected around the core device and the conductive clip. The SMD is cured until the A-staged material becomes C-staged. Alternatively, the A-staged material may be partially cured to a B-staged level. This may be desired if some intermediate process is required before full cure. The core device is substantially surrounded by an oxygen-barrier material.

In a third aspect, a method for producing a surface mount device includes providing a first and second substrate layer. The first and second substrate layers each include a generally L-shaped interconnect that defines a surface mount device contact surface along a top surface of the substrate, a middle region that extends through the substrate layer, and a core device contact that extends along a bottom surface of the substrate layer. A top surface of a core device is fastened to the core device contact of the interconnect of the first substrate. A bottom surface of the core device is fastened to the core device contact of the interconnect of the second substrate. An A-staged material is injected around the core device and cured until the material becomes C-staged. The core device is substantially surrounded by an oxygen-barrier material.

In a fourth aspect, a surface mount device comprises a core device with a top surface and a bottom surface. A C-staged oxygen-barrier insulator material substantially encapsulates the core device. A first contact pad and a second contact pad are disposed on an outside surface of the oxygen-barrier insulator material. The first contact pad and the second contact pad are configured to provide an electrical path from the top surface of the core device and the bottom surface of the core device to a first and second pad, respectively, defined by the a substrate and/or printed circuit board.

BRIEF DESCRIPTION OF THE DRAWINGS

FIGS. 8A and 8B are top and bottom views, respectively, of a third implementation of a surface mount device (SMD);

FIG. 8C is a cross-sectional view of the SMD of FIG. 8A taken along section A-A.

DETAILED DESCRIPTION

Figure 1A:
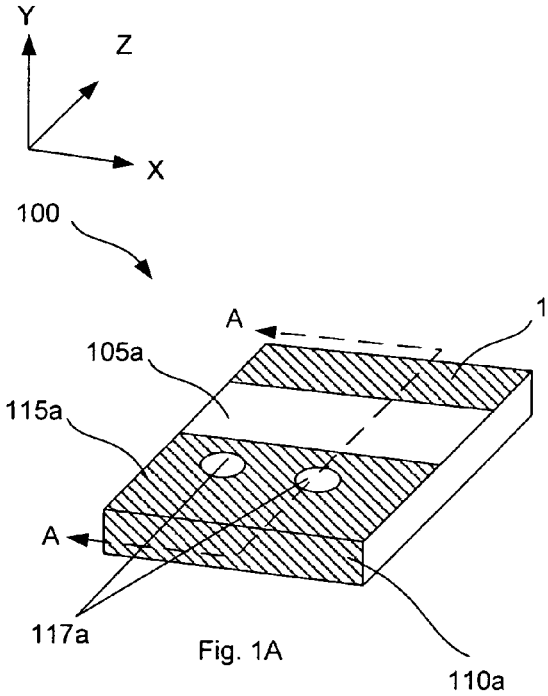
FIGS. 1A and 1B are top and bottom views, respectively, of one implementation of a surface mount device (SMD)

To overcome the problems described above, various implementations of SMDs that include an oxygen-barrier material are disclosed. The various implementations generally utilize insulator materials to protect a core device from the effects of oxygen and other impurities. In some implementations, the insulator material may correspond to one of the oxygen-barrier materials described in U.S. patent application Ser. No. 12/460,338, filed on Jul. 17, 2009, contemporaneously with this application which is hereby incorporated by reference in its entirety. The oxygen-barrier material may have an oxygen permeability of less than approximately 0.4 cm3·mm/m2·atm·day (1 cm3·mil/100 in2·atm·day), measured as cubic centimeters of oxygen permeating through a sample having a thickness of one millimeter over an area of one square meter. The permeation rate is measured over a 24 hour period, at 0% relative humidity, and a temperature of 23° C. under a partial pressure differential of one atmosphere). Oxygen permeability may be measured using ASTM F-1927 with equipment supplied by Mocon, Inc., Minneapolis, Minn., USA.

The insulator material generally comprises one or more thermosetting polymers, such as an epoxy. The insulator material may exist in one of three physical states, an A-staged, B-staged, and a C-staged state. An A-staged state, is characterized by a composition with a linear structure, solubility, and fusibility. In certain embodiments, the A-staged composition may be a high viscosity liquid, having a defined molecular weight, and comprised of largely unreacted compounds. In this state, the composition will have a maximum flow (in comparison to a B-staged or C-staged material). In certain embodiments, the A-staged composition may be changed from an A-staged state to either a B-staged state or a C-staged state via either a photo-initiated reaction or thermal reaction.

A B-staged state is achieved by partially curing an A-stage material, wherein at least a portion of the A-stage composition is crosslinked, and the molecular weight of the material increases. Unless indicated otherwise, B-stageable compositions can be achieved through either a thermal latent cure or a UV-cure. In certain embodiments, the B-stageable composition is effectuated through a thermal latent cure. B-staged reactions can be arrested while the product is still fusible and soluble, although having a higher softening point and melt viscosity than before. The B-staged composition contains sufficient curing agent to affect crosslinking on subsequent heating. In certain embodiments, the B-stage composition is fluid, or semi-solid, and, therefore, under certain conditions, can experience flow. In the semi-solid form, the thermosetting polymer may be handled for further processing by, for example, and operator. In certain embodiments, the B-stage composition comprises a conformal tack-free film, workable and not completely rigid, allowing the composition to be molded or flowed around an electrical device.

A C-staged state is achieved by fully curing the composition. In some embodiments, the C-staged composition is fully cured from an A-staged state. In other embodiments, the C-staged composition is fully cured from a B-staged state. Typically, in the C-stage, the composition will no longer exhibit flow under reasonable conditions. In this state, the composition may be solid and, in general, may not be reformed into a different shape.

Another formulation of insulator material is a prepreg formulation. Prepreg formulations generally correspond to a B-staged formulation with a reinforcing material. For example, fiberglass or a different reinforcing material may be embedded within the B-stage formulation. This enables the manufacture of sheets of B-staged insulator material.

The insulator materials described above enable the production of surface mount devices or other small devices that exhibit a low oxygen permeability. For example, the insulator material enables producing low oxygen permeability surface mount devices with wall thicknesses less than 0.35 mm (0.014 in).

Figure 1B:
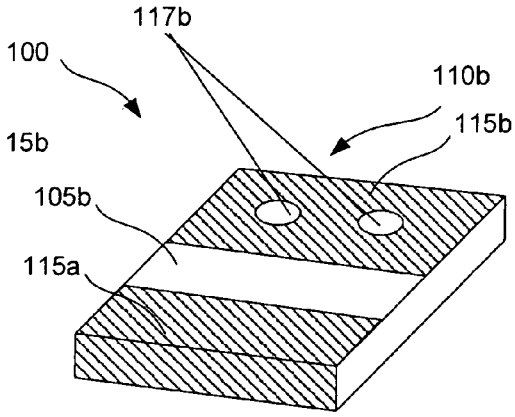
Figure 1C:
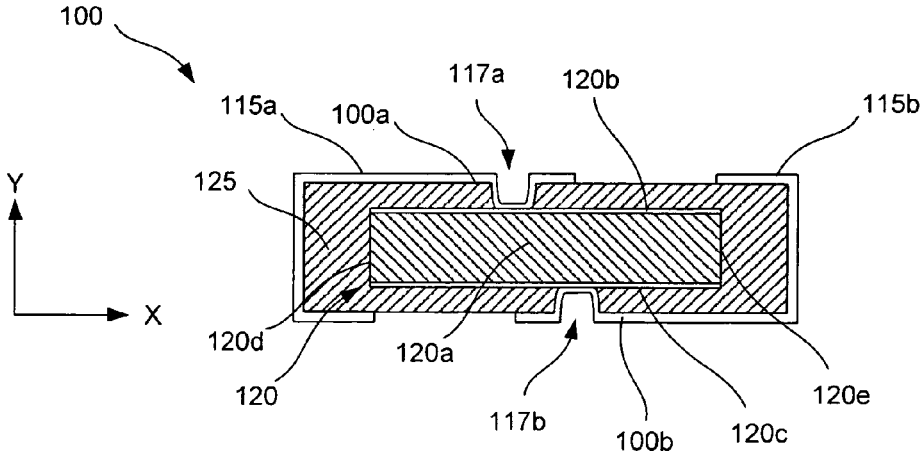
FIG. 1C is a cross-sectional view of the SMD of FIG. 1A taken along section A-A of FIG. 1A.

FIGS. 1A and 1B are top and bottom views, respectively, of one implementation of a surface mount device (SMD) 100. The SMD 100 includes a generally rectangular body with a top surface 105*a*, a bottom surface 105*b*, a first end 110*a*, a second end 110*b*, a first contact pad 115*a*, and a second contact pad 115*b*. The first contact pad 115*a* and the second contact pad 115*b* extend from the top surface 105*a* of the SMD 100, over the first end 110*a* and second end 110*b*, respectively, and over the bottom surface 105*b*. The first contact pad 115*a* defines a first pair of openings 117*a* and the second contact pad 115*b* defines a second pair of openings 117*b*, as shown in FIGS. 1A and 1B, respectively. The first and second pairs of openings 117*a*, 117*b* are configured to bring the first and second contact pads 115*a*, 115*b* into electrical communication with an internally located cored device 120, as shown in FIG. 1C. In one implementation, the size of the SMD 100 may be about 3.0 mm by 2.5 mm by 0.7 mm (0.120 in by 0.100 in by 0.028 in) in an X, Y, and Z direction, respectively.

FIG. 1C is a cross-sectional view of the SMD 100 of FIG. 1A taken along section A-A of FIG. 1A. The SMD 100 includes a first contact pad 115*a*, a second contact pad 115*b*, a core device 120, and an insulator material 125. The core device 120 may correspond to a device that has properties that deteriorate in the presence of oxygen. For example, the core device 120 may correspond to a low-resistance positive-temperature-coefficient (PTC) device comprising a conductive polymer composition. The electrical properties of conductive polymer composition tend to deteriorate over time. For example, in metal-filled conductive polymer compositions, e.g. those containing nickel, the surfaces of the metal particles tend to oxidize when the composition is in contact with an ambient atmosphere, and the resultant oxidation layer reduces the conductivity of the particles when in contact with each other. The multitude of oxidized contact points may result in a 5× or more increase in electrical resistance of the PTC device. This may cause the PTC device to exceed its original specification limits. The electrical performance of devices containing conductive polymer compositions can be improved by minimizing the exposure of the composition to oxygen.

The core device 120 may include a body 120*a*, a top surface 120*b*, and a bottom surface 120*c*. The body 120*a* may have a generally rectangular shape, and in some implementations, may be about 0.3 mm (0.012 in) thick along a Y axis, 2 mm (0.080 in) long along an X axis, and 1.5 mm (0.060 in) deep along a Z axis. The top and bottom surfaces 120*b* and 120*c* may comprise a conductive material. For example, the top and bottom surfaces 120*b* and 120*c* may comprise a 0.025 mm (0.001 in) thick layer of nickel (Ni) and/or a 0.025 mm (0.001 in) thick layer of copper (Cu). The conductive material may cover the entire top and bottom surfaces 120*b* and 120*c* of the core device 120.

In some implementations, the insulator 125 may correspond to an oxygen-barrier material, such as one of the oxygen-barrier materials described in U.S. patent application Ser. No. 12/460,338, filed contemporaneously with this application. The oxygen-barrier material may prevent oxygen from permeating into the core device, thus preventing deterioration of the properties of the core device. The thickness of the insulator 125 from the top surface 120*b* of the core device 120 to the top surface 100*a* of the SMD 100 along a Y axis may be in the range of 0.01 to 0.125 mm (0.0004 to 0.005 in), e.g. about 0.056 mm (0.0022 in). The thickness of the insulator 125 from an end of the core device 120*d* and 120*e* to an end of the SMD 100 along an X axis may be in the range of 0.025 to 0.63 mm (0.001 to 0.025 in), e.g. about 0.056 mm (0.0022 in).

The first and second contact pads 115*a* and 115*b* are utilized to fasten the SMD 100 to a printed circuit board or substrate (not shown). For example, the SMD 100 may be soldered to pads on a printed circuit board and/or substrate via one surface of the first and second contact pads 115*a* and 115*b*. As described above, the first contact pad 115*a* may define a first pair of openings 117*a* and the second contact pad 115*b* may define a second pair of openings 117*b*. On the first contact pad 115*a*, the first pair of openings 117*a* may extend from the top surface 100*a* of the SMD 100 to the top surface 120*b* of the core device 120. On the second contact pad 115*b*, the second pair of openings 117*b* may extend from the bottom surface 100*b* of the SMD 100 to the bottom surface 120*c* of the core device 120. The interior of each opening of the first and second pairs of openings 117*a*, 117*b* may be plated with a conductive material, such as copper. The plating may provide an electrical pathway from the outside of the SMD 100 to the core device 120.

Figure 2:
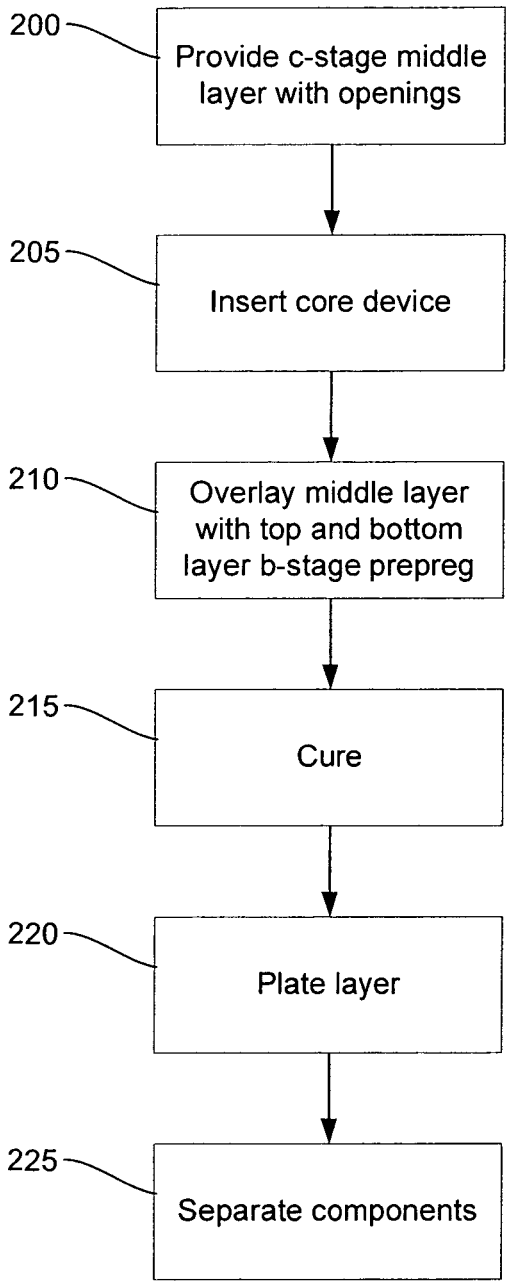
FIG. 2 illustrates an exemplary group of operations that may be utilized to manufacture the SMD described in FIGS. 1A-1C.

FIG. 2 illustrates an exemplary group of operations that may be utilized to manufacture the SMD described in FIGS. 1A-1C. The operations shown in FIG. 2 are described with reference to the structures illustrated in FIGS. 3, 4A, and 4B. At block 200, a C-staged middle layer 310 may be provided and openings 312 may be defined in the middle layer, as shown in FIG. 3.

Figure 3:
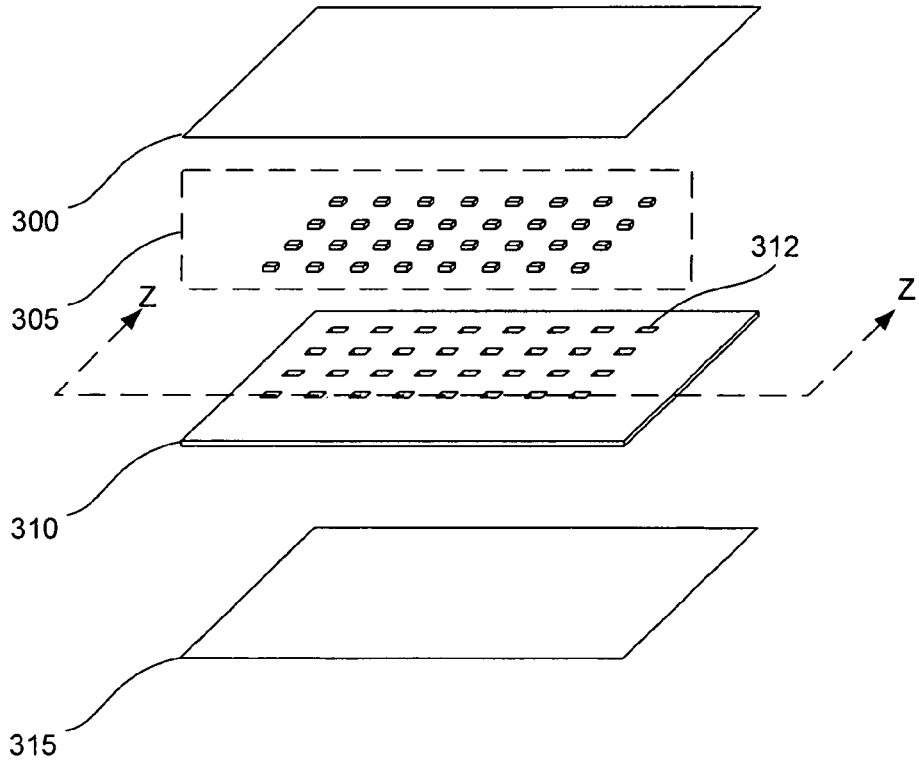
FIG. 3 illustrates a top, middle, and bottom layer of the SMD of FIGS. 1A-1C.

Referring to FIG. 3, the middle layer 310 may correspond to a generally planar sheet of C-staged insulator material. The thickness of the sheet is generally at least as thick as the core device 120, and may be, for example, about 0.38 mm (0.015 in) in the Y direction.

The openings 312 in the sheet may be sized to receive a core device 305, such as the core device 120 described above in FIG. 1C. In some implementations, the size of the openings 312 may be about 2.0 mm by 1.5 mm by 0.36 mm (0.080 in by 0.060 in by 0.014 in), in the X, Y, and Z directions, respectively.

In some implementations, the openings 312 are cut out from the middle layer 310. For example, the openings 312 may be cut out with a laser. In other implementations, the middle layer 310 is fabricated via a mold that defines the openings 312. In yet other implementations, a punch is utilized to punch the openings 312 in the middle layer 310.

Referring back to FIG. 2, at block 205, core devices 305 may be inserted into the openings 312. Each core device 305 may correspond to the core device 120 described above in conjunction with FIGS. 1A-1C. As shown in FIG. 3, the core devices 305 may be inserted into corresponding openings 312 in the middle layer 310. The core devices 305 may be inserted into the openings 312 by hand, be placed in the openings 312 with pick-and-place machinery, vibratory sifting table, and/or via a different process.

Referring back to FIG. 2, at block 210, the middle layer 310 with the inserted core devices 305 may be placed between two insulator layers 300 and 315, as shown in FIG. 3.

Referring to FIG. 3, the middle layer 310 and the core device 305 may be inserted between a top insulator layer 300 and a bottom layer insulator layer 315. The top and bottom insulator layers 300 and 315 may correspond to a prepreg B-staged formulation, as described above. The top and bottom insulator layers 300 and 315 may have a generally planar shape and may have a thickness of about 0.056 mm (0.0022 in) in the Y direction. The width and depth of the top and bottom insulator layers 300 and 315 in the X and Z directions, respectively, may be sized to overlap all of the openings 312 defined in the middle layer 310.

Referring back to FIG. 2, at block 215, the top, middle, and bottom layers 300, 310 and 315 may be cured. In some implementations, a metal layer (not shown) may be placed over the top insulator layer 300 and under the bottom insulator layer 315. The metal layers may correspond to a copper foil. The various layers may then be subjected to a curing temperature, and pressure may be applied to the various layers to compress the layers. For example, a vacuum press or other device may be utilized to compress the various layers against one another. The curing temperature may be about 175° C. and the amount of pressure applied may be about 1.38 MPa (200 psi).

Figure 4A:
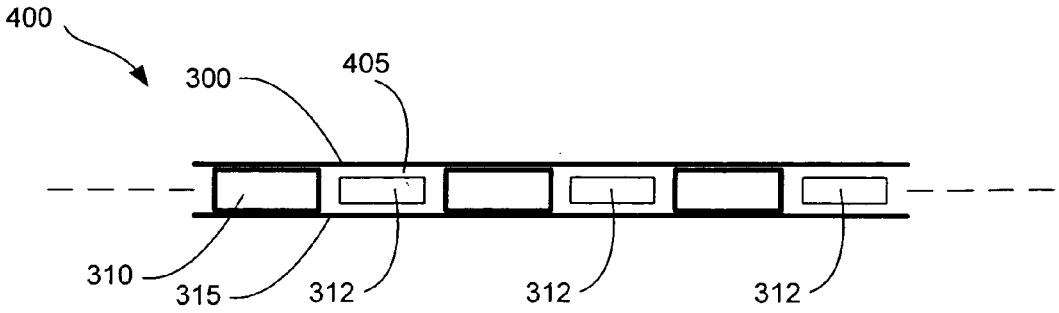
FIG. 4A is a cross-sectional view of the top layer, middle layer, and bottom layer of FIG. 3 taken along section Z-Z of FIG. 3 before the layers are cured.
Figure 4B:
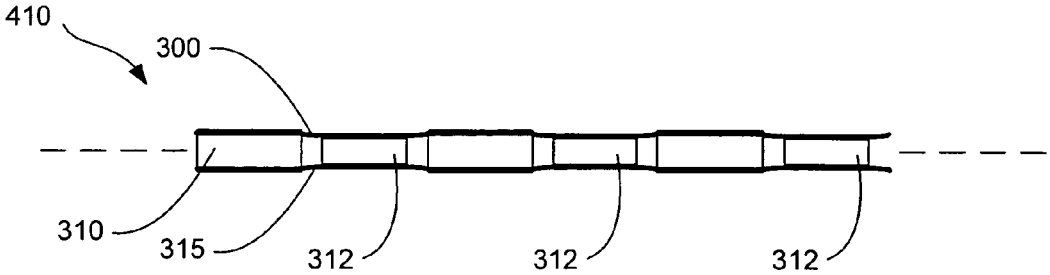
FIG. 4B is a cross-sectional view of the top layer, middle layer, and bottom layer of FIG. 3 taken along section Z-Z of FIG. 3 after the layers are cured.

FIGS. 4A and 4B are cross-sectional views 400 and 410 of the top insulator layer 300, middle layer 310, and bottom insulator layer 315 taken along section Z-Z of FIG. 3, before and after curing of the various layers, respectively. In FIG. 4A, a gap 405 is defined between the top and bottom layers 300 and 315 and the core devices 312 are inserted in the openings of the middle layer 310. In FIG. 4B, after curing, the top and bottom layers 300 and 315 are compressed such that the gap 405 is reduced by the thickness of the reinforcing material of the B-staged prepregs.

Figure 4C:
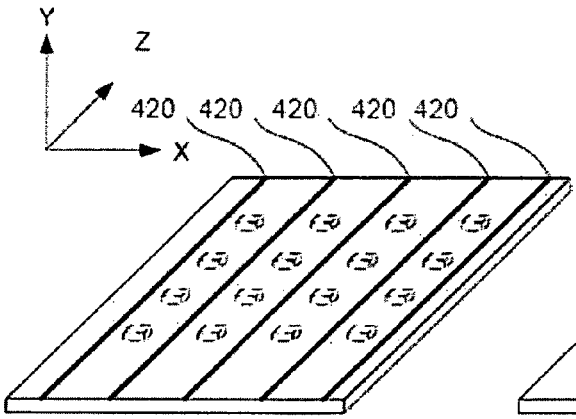
FIG. 4C is a perspective view of cured layers with slots formed in-between core devices encapsulated in the cured layers.

Apertures for plating regions that will ultimately correspond to the ends of a PTC device may be defined between the cured layers. In one implementation, slots that extend through the layers are formed between rows of devices. For example, referring to FIG. 4C the direction of the slots 420 may run in the Z direction. The slots 420 may be formed via a laser, mechanical milling, punching, or other process.

Figure 4D:
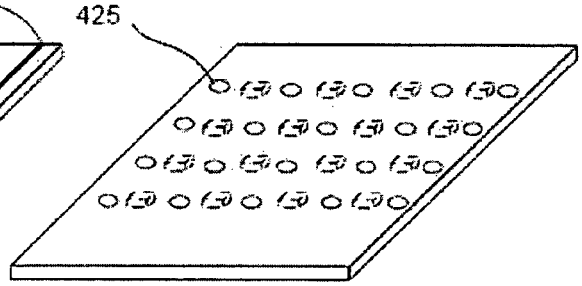
FIG. 4D is a perspective view of cured layers with holes formed in between core devices encapsulated in the cured layers.

In a different implementation, holes 425 may be formed between devices and shared between devices in a column that runs in the X direction, as shown in FIG. 4D. The holes 425 may be formed by laser, mechanical drilling, or a different process. In a later operation, the interior surfaces of the holes 425 are plated to produce channel ends such as the channel ends 835*a* and 835*b* shown on the PTC device 800 in FIGS. 8A and 8B, and described below.

At block 220, a metallization layer (not shown) may be formed on the top and bottom layers 300 and 315 and also the apertures that expose the ends of the individual PTC devices. For example, a copper and/or nickel layer may be deposited on the top and bottom layers. The metallization layer may be etched to define contact pads for an SMD. The contact pads may correspond to the contact pads 115*a* and 115*b* of FIG. 1. Openings may be defined in the plating layer. The openings may correspond to one or more of the openings of the first and second pairs of openings 117*a* and 117*b* of FIG. 1. The openings may be defined via a drill, laser, or other process. The interior region of the openings may be plated to provide an electrical pathway between the contact pads and the core devices. Where slots are formed between rows of devices, the ends of the PTC device 110*a* and 110*b* (FIG. 1A) may be metalized, as shown in FIG. 1A and FIG. 1B. Where holes are formed between devices, the interior surface of the holes may be metalized. In this case, the ends of the PTC device may appear similar the channels ends 835*a* and 835*b* shown on the PTC device 800 in FIGS. 8A and 8B, and described below.

At block 225, the consolidated structure of cured layers may be cut with a saw, laser, or other tool to produce individual SMDs.

In some implementations, the top layer, middle layer, and bottom layer 300, 310 and 315 correspond to an oxygen-barrier material, as described above. The oxygen-barrier properties of the top, middle, and bottom layers prevent oxygen from entering the core device, thus preventing adverse changes in the properties of the core device. For example, the oxygen-barrier insulator material may prevent the 5× increase in resistance noted above that would otherwise occur in a PTC device.

In other implementations, the layers from which the insulator is comprised of may comprise a material that does not exhibit oxygen-barrier properties. In these implementations, the core device may be coated with a liquid form of oxygen-barrier material, such as one of the barrier materials described in U.S. Pat. No. 7,371,459 B2, issued on May 13, 2008, which is hereby incorporated by reference in its entirety. The liquid form of oxygen-barrier material may include a solvent that enables depositing the oxygen-barrier material on the core device. The solvent may then evaporate, leaving a hardened form of the oxygen-barrier material on the core device. The core device may then be packaged as described in FIG. 2 above.

Alternatively, a barrier layer as described in U.S. Pat. No. 4,315,237, issued on Feb. 9, 1982, which is hereby incorporated by reference in its entirety, may be utilized to encapsulate the core device.

It will be understood by those skilled in the art that the SMD described above may be manufactured in different ways without departing from the scope of the claims. For example, in one alternative implementation, the SMD may be manufactured by providing a C-staged bottom layer with recesses for receiving core devices rather than openings. The C-staged bottom layer may then be covered by a B-staged top layer and cured as described above.

In yet other implementations, the core devices may be placed into the openings and/or recesses defined by the C-staged layer described above. Then an A-staged oxygen-barrier material may be forced into the openings and/or recesses to cover the core devices. For example, the A-staged layer may be squeezed into the openings and/or recesses. Finally, B-staged layers may be placed above and/or below the C-staged layer and the assembly may be cured as described above.

In yet another implementation, the core devices may be encapsulated within the openings and/or recess as described above and an oxygen-barrier material that is A-staged, B-staged, C-staged, or any combination thereof may be configured to cover the assembly covering the core devices.

In yet another implementation, the core devices may be inserted within the openings and/or recesses as described above and ultraviolet (UV) radiation curable oxygen-barrier material may be configured to cover the assembly covering the core devices. The assembly may then be thermally cured as described above.

One of ordinary skill will appreciate that the various implementations described above may be combined in various ways to produce an SMD with oxygen-barrier characteristics.

Figure 5A:
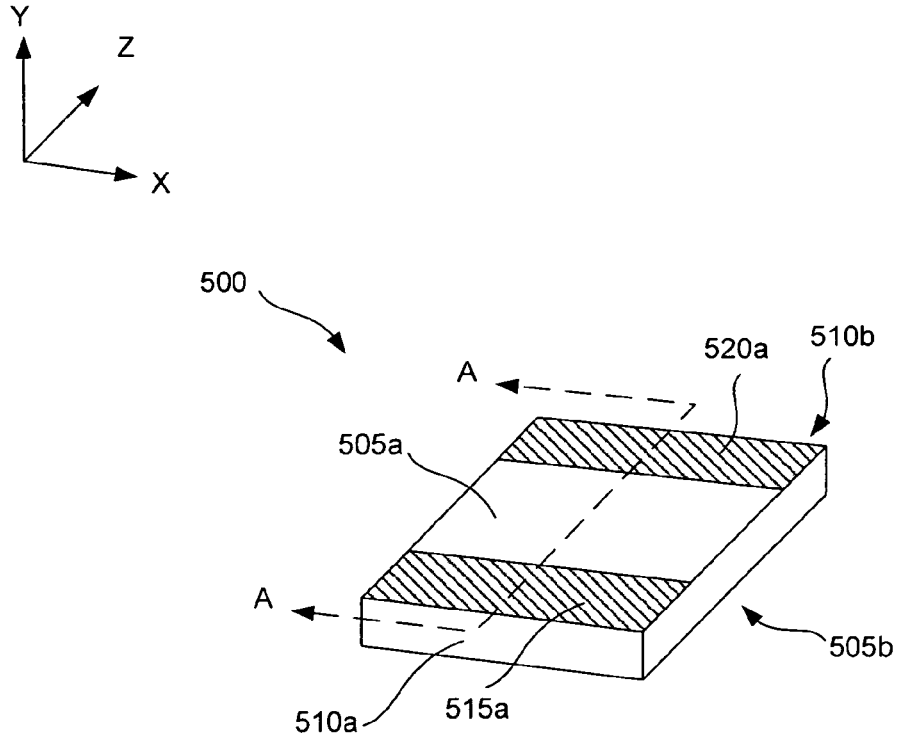
FIG. 5A is a top-perspective view of another implementation of a surface mount device (SMD)

FIG. 5A is a bottom perspective view of another implementation of a surface mount device (SMD) 500. The SMD 500 includes a generally rectangular body with a top surface 505*a*, a bottom surface 505*b*, a first end 510*a*, a second end 510*b*, a first contact pad 515*a*, and a second contact pad 520*a*. The first and second contact pads 515*a* and 520*a* are disposed on opposite ends of the bottom surface 505*a*, and in some implementations, are separated from one another by a distance of about 2.0 mm (0.080 in). The size of the SMD 500 may be about 3.0 mm by 2.5 mm by 0.71 mm (0.120 in by 0.100 in by 0.028 in) in the X, Y, and Z directions, respectively.

Figure 5B:
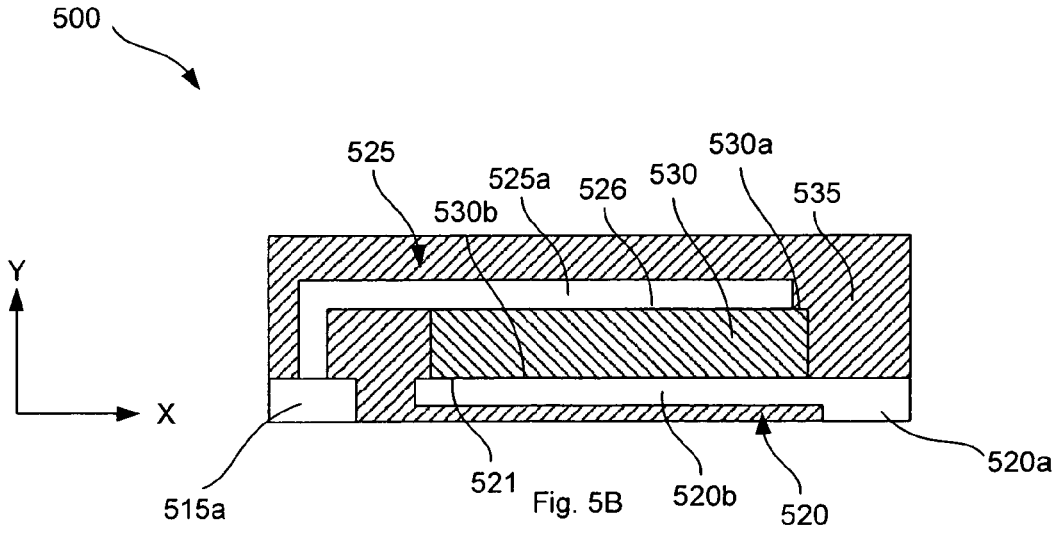
FIG. 5B is a cross-sectional view of the SMD of FIG. 5A taken along section A-A.

FIG. 5B is a cross-sectional view of the SMD 500 of FIG. 5A taken along section A-A. The SMD 500 includes a first contact pad 515*a*, a contact interconnect 520, a core device 530, a clip interconnect 525, and an insulator material 535. The core device 530 may correspond to a device that has properties that deteriorate in the presence of oxygen, such as the PTC device described above. The core device 530 may comprise a top surface 530*a*, and a bottom surface 530*b*. The core device 530 may be generally rectangular and may have a thickness of about 2.0 mm by 0.30 mm by 1.5 mm (0.080 in by 0.012 in by 0.060 in) in the X, Y, and Z directions, respectively. The top and bottom surfaces 530*a* and 530*b* may comprise a conductive material. For example, the top and bottom surfaces 530*a* and 530*b* may comprise a 0.025 mm (0.001 in) thick layer of nickel (Ni) and/or a 0.025 mm (0.001 in) thick layer of copper (Cu). The conductive material may cover the entire top and bottom surfaces 530*a* and 530*b* of the core device.

In some implementations, the insulator 535 may correspond to a C-staged oxygen-barrier material, such the oxygen-barrier material described above. The oxygen-barrier material may prevent oxygen from permeating into the core device.

The contact interconnect 520 may include a contact pad 520*a*, hereinafter referred to as the second contact pad 520*a*, and an extension 520*b*. The extension 520*b* includes a top surface 521 in electrical contact with the bottom surface 530*b* of the core device 530. The extension 520*b* may be about 2.0 mm (0.080 in) in the X direction and 0.13 mm (0.005 in) in the Z direction.

The first and second contact pads 515*a* and 520*a* are utilized to fasten the SMD 500 to a printed circuit board or substrate (not shown). For example, the SMD 500 may be soldered to pads on a printed circuit board and/or substrate via the first and second contact pads 515*a* and 520*a*.

The clip interconnect 525 is generally L-shaped and provides an electrical path between the first contact pad 515*a* and the top surface 530*a* of the core device 530. The clip interconnect 525 includes a horizontal section 525*a*. The horizontal section 525*a* of the clip 525 may include a bottom surface 526 in electrical contact with the top surface 530*a* of the core device 530. The bottom surface 526 of the horizontal section 525*a* may be about 2.5 mm (0.100 in) in the X direction and 1.0 mm (0.040 in) in the Z direction.

Figure 6:
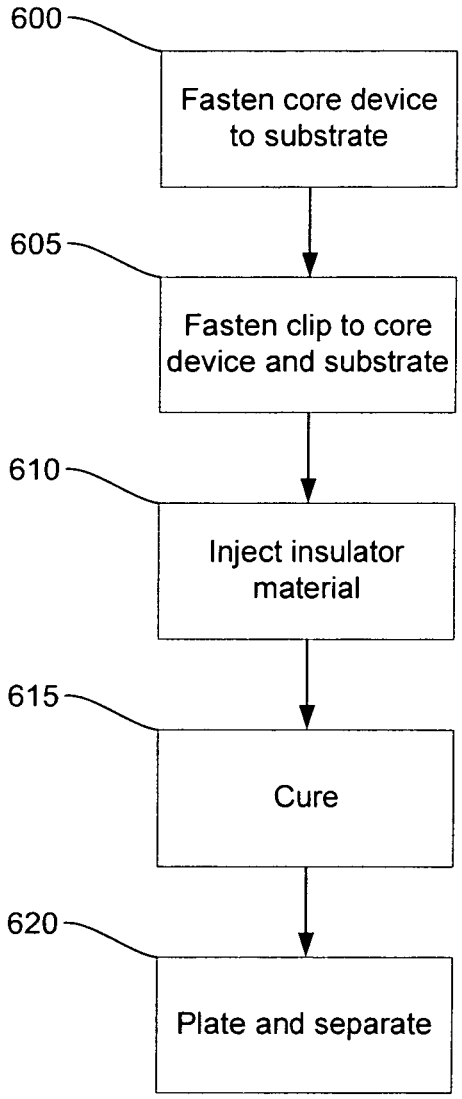
FIG. 6 illustrates an exemplary group of operations that may be utilized to manufacture the SMD described in FIGS. 5A and 5B.
Figure 7:
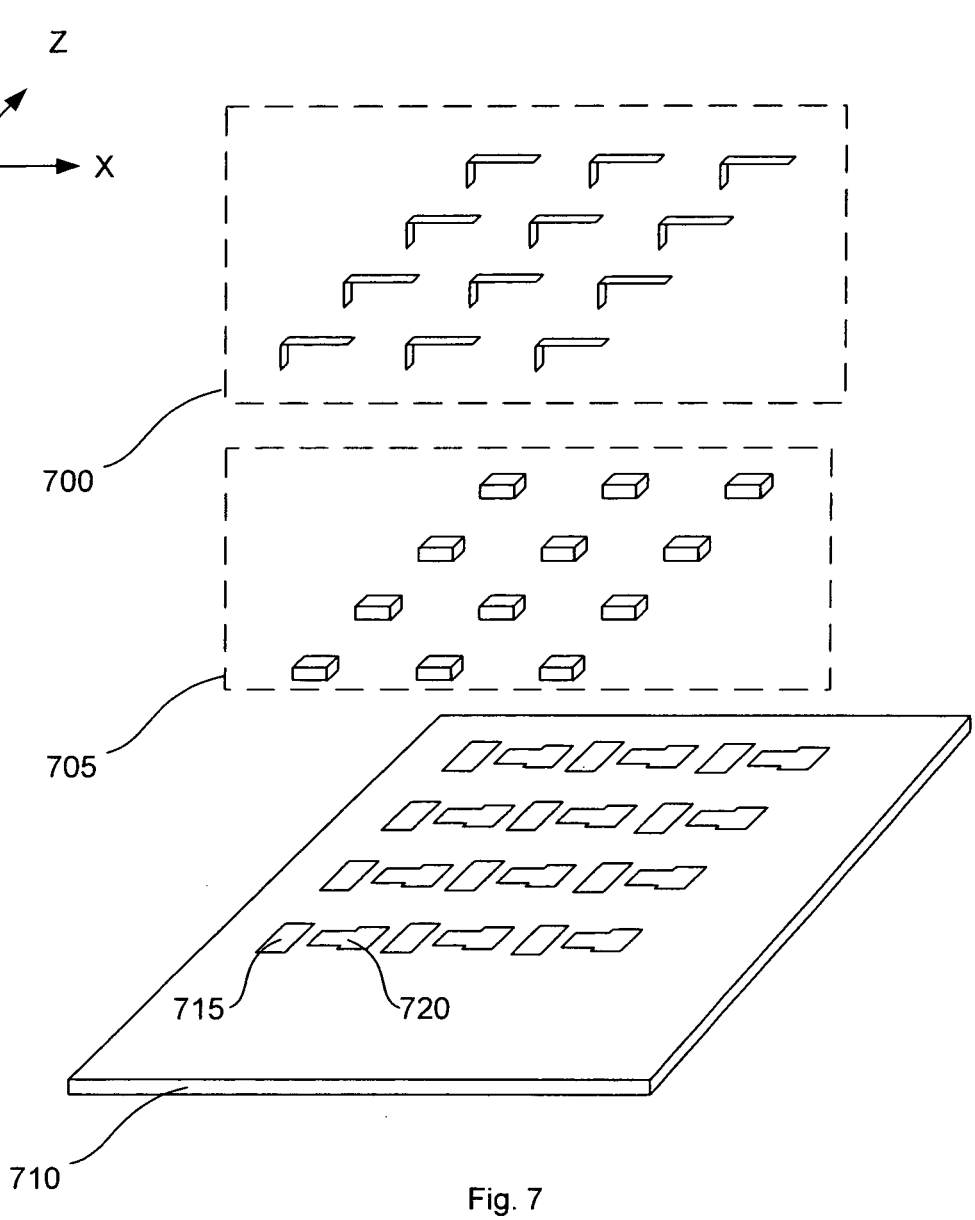
FIG. 7 illustrates layers of the SMD of FIGS. 5A and 5B.

FIG. 6 illustrates an exemplary group of operations that may be utilized to manufacture the SMD described in FIGS. 5A and 5B. The operations shown in FIG. 6 are described with reference to the structures illustrated in FIG. 7. At block 600, core devices 705 may be fastened to a substrate 710. Each core device 705 may correspond to a PTC device, as described above. The core devices 705 may be placed over the substrate 710. The core devices 705 may be fastened by hand, via pick-and-place machinery, and/or via a different process.

The substrate 710 may correspond to a metal lead frame or a printed circuit board that defines a plurality of contact pads 715 and contact interconnects 720. The contact pads 715 and contact interconnects 720 may correspond to the contact pad 515*a* and the contact interconnect 520 in FIG. 5. The thickness of the substrate 710 may be about 0.2 mm (0.008 in) in the Y direction. The core devices 705 may be fastened to the contact interconnects 720 defined on the substrate 710. For example, the bottom surfaces of the core devices 705 may be soldered to the top surfaces of the extensions on the contact interconnects 720.

At block 605, the clip interconnects 700 may be fastened to the core device and the substrate. The horizontal sections of the clip interconnects 700 may be fastened to the top surfaces of the core devices 705, and the opposite end of the clip interconnects 700 may be fastened to the contact pads 715. For example, the clip interconnects 700 may be soldered to the top surfaces of the core devices 705 and the contact pads 715.

At block 610, an insulator material may be injected around the core devices 705 and the clip interconnects 700. The insulator material may correspond to an A-staged material.

At block 615, the insulator material may be cured. For example, a curing temperature of 150° C. may be applied to the insulator material to convert the material into a C-staged formulation.

At block 620, individual SMDs may be separated from the cured configuration. For example, the SMDs may be cut from the cured configuration with a saw, laser, or other tool.

In some implementations, the insulator material may correspond to an oxygen-barrier material, as described above. In other implementations, the insulator material comprises a material that does not exhibit oxygen-barrier properties. Rather, the core device may be coated with a liquid form of an oxygen-barrier material, such as the liquid form of oxygen-barrier material described above, before the insulator material is injected around the core device.

In alternative implementations, the clip interconnects 700 may be integral to the substrate. For example, the clip interconnects 700 may be integral to a metal lead frame.

In other alternative implementations, the clip interconnects 700 may be configured to provide an elastic force against the core devices 705. The core devices 705 may be inserted in between the horizontal sections 525*a* (FIG. 5) of the clip interconnects 700 and the contact pads 520*a* (FIG. 5) of the contact interconnects 720. The elastic force of the clip interconnects 700 may be strong enough to secure the core devices 705 in position and thereby provide a secure electrical contact with the core devices. After insertion of the core devices 705, the operations from block 610 (FIG. 6) may be performed.

FIGS. 8A and 8B are top and bottom views, respectively, of a third implementation of a surface mount device (SMD) 800. The SMD 800 includes a generally rectangular body with a top surface 805*a*, a bottom surface 805*b*, a first end 810*a*, a second end 810*b*, a first contact pad 815*a*, and a second contact pad 815*b*. The first and second contact pads 815*a* and 815*b* extend from the top surface 805*a* of the SMD 800, through end channels 835*a* and 835*b*, respectively, and over the bottom surface 805*b*. The size of the SMD 800 may be about 3.0 mm by 2.5 mm by 0.71 mm (0.120 in by 0.100 in by 0.028 in) in X, Y, and Z directions, respectively.

FIG. 8C is a cross-sectional view of the SMD 800 of FIG. 8A taken along section A-A. The SMD 800 includes a top substrate layer 820*a*, a bottom substrate layer 820*b*, a core device 825, an insulator material 830, a first end channel 835*a*, and a second end channel 835*b*. The core device 825 may correspond to a device that has properties that deteriorate in the presence of oxygen. For example, the core device 825 may correspond to the core devices described above.

Each of the top and bottom substrate layers 820*a* and 820*b* includes a first contact surface 821, a contact interconnect 823, and a substrate core 827. The contact interconnect 823 may be a generally L-shaped conductive material and may define a second contact surface 822 on one end and a component contact surface 829 on the opposite end. The contact surface 822 of the contact interconnect 823 may be defined on an outer side of the top or bottom substrate layer 820*a* and 820*b* that faces away from the core device 825, and the component contact surface 829 may be defined on an inner side of the top or bottom substrate layer 820*a* and 820*b* that faces the core device 825. The substrate core 827 may correspond to a hardened epoxy fill or a fiberglass circuit board material.

The component contact surface 829 of the upper substrate layer 820*a* is sized to cover the top side of the core device 825. The component contact surface 829 of the lower substrate layer 820*b* is sized to cover the bottom side of the core device 825.

The first and second channels 835*a* and 835*b* are disposed on opposite ends of the SMD 800. The first channel 835*a* may extend from the first contact surface 821 on the upper substrate 820*a* to the second contact surface on the lower substrate 820*b*. The second channel 835*b* may extend from the first contact surface 821 on the lower substrate 820*b* to the second contact surface 822 on the upper substrate 820*a*. The interior surface of the channels 835*a* and 835*b* may be plated to provide an electrical path between the contact pads on the upper and lower substrates 820*a* and 820*b*, respectively.

The first contact surface 821 on the upper substrate 820*a* and the second contact surface 822 on the lower substrate 820*b* may define the first contact pad 815*a* in FIG. 8A. The first contact surface 821 on the lower substrate 820*b* and the second contact surface 822 on the upper substrate 820*a* may define the second contact pad 815*b* in FIG. 8A. The first and second contact pads 815*a* and 815*b* are utilized to fasten the SMD 800 to a printed circuit board or substrate (not shown). For example, the SMD 800 may be soldered to pads on a printed circuit board and/or substrate via the contact pads 815*a* and 815*b*.

In some implementations, the insulator 830 may correspond to a C-staged oxygen-barrier material, such as the C-staged oxygen-barrier material described above. The insulator 830 may be utilized to fill in the region in between the ends of the core 825 device and ends of the SMD 800.

Figure 9:
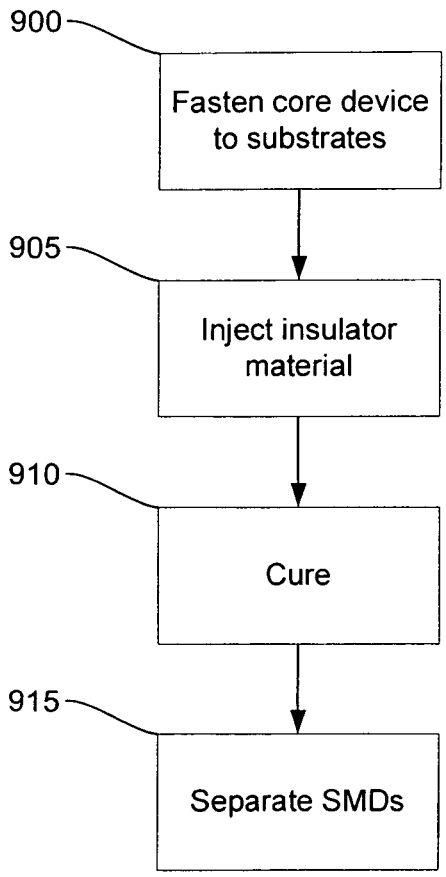
FIG. 9 illustrates an exemplary group of operations that may be utilized to manufacture the SMD described in FIGS. 8A-8C.

FIG. 9 illustrates an exemplary group of operations that may be utilized to manufacture the SMD described in FIGS. 8A-8C. At block 900, a core device may be fastened in between an upper and lower substrate. The core device may correspond to a PTC device, as described above. In some implementations, an array of core devices may be fastened to the upper and lower substrates. The core devices may be fastened by hand, via pick-and-place machinery, and/or via a different process.

The substrate may correspond to a printed circuit board with conductive layers on a two sides, as described above. The thickness of the substrate may be about 0.076 mm (0.003 in) in the Y direction. The core devices may be fastened to component contact surfaces defined on the respective substrates.

At block 905, an insulator material may be injected around the core device and clip interconnect. The insulator material may correspond to an A-staged material, as described above.

At block 910 the insulator material may be cured at a curing temperature. For example, a curing temperature of 150° C. may be applied to the insulator material to convert the material into a C-staged formulation.

At block 915, individual SMDs may be separated from the cured configuration. For example, the SMDs may be cut from the cured configuration with a saw, laser, or other tool.

In some implementations, the insulator material may correspond to an oxygen-barrier material, as described above. In other implementations, the insulator material comprises a material that does not exhibit oxygen-barrier properties. Rather, the core device may be coated with a liquid form of an oxygen-barrier material, such as the liquid form of oxygen-barrier material described above, before the insulator material is injected around the core device.

As shown, the various implementations overcome the problems caused by oxygen on a core device disposed inside of a surface mount device (SMD) by providing an SMD that includes an oxygen-barrier material for an insulator material. The insulator material protects the core device within the SMD from the effects of oxygen and other impurities. In some implementations, the insulator material is formulated into sheets of B-staged oxygen-barrier material and in other implementations A-staged oxygen barrier materials are utilized.

While the SMD and the method for manufacturing the SMD have been described with reference to certain embodiments, it will be understood by those skilled in the art that various changes may be made and equivalents may be substituted without departing from the scope of the claims of the application. Many other modifications may be made to adapt a particular situation or material to the teachings without departing from the scope of the claims. Therefore, it is intended that SMD and method for manufacturing the SMD are not to be limited to the particular embodiments disclosed, but to any embodiments that fall within the scope of the claims.

We claim:

1. A method for producing a surface mount device comprising:

providing a first substrate layer and a second substrate layer, the first and second substrate layers each including a generally L-shaped interconnect that defines a surface mount device contact surface along a top surface of the substrate layer, a middle region that extends through the substrate layer, and a component contact surface that extends along a bottom surface of the substrate layer, respectively;

fastening a top surface of a core device to the component contact surface of the interconnect of the first substrate layer;

fastening a bottom surface of the core device to the component contact surface of the interconnect of the second substrate layer;

injecting an A-staged material around the core device; and curing the A-staged material until the A-staged material become C-staged material, wherein the core device is substantially surrounded by an oxygen-barrier material.

2. A method for producing a surface mount device comprising:

providing a plurality of layers including a first layer that is B-staged, a second layer that defines an opening for receiving a core device, and a third layer that is B-staged;

placing the third layer that is B-staged below the second layer that defines the opening before curing;

inserting the core device in the opening defined by the second layer;

covering the second layer and the core device with the first layer that is B-staged; and curing the first layer and second layer until the first layer that is B-staged becomes C-staged;

wherein the core device is substantially surrounded by an oxygen-barrier material with an oxygen permeability of less than approximately 0.4 cm3·mm/m2·atm·day.

3. The method according to claim 1, wherein the core device is a positive-temperature-coefficient (PTC) device.

4. A method for producing a surface mount device comprising:

providing a plurality of layers including a first layer that is B-staged and a second layer that defines an opening for receiving a core device;

applying an oxygen-barrier material to a core device before insertion of the core device in the opening defined by the second layer;

inserting the core device in the opening defined by the second layer;

covering the second layer and the core device with the first layer that is B-staged;

curing the first layer and second layer until the first layer that is B-staged becomes C-staged, wherein the core device is substantially surrounded by an oxygen-barrier material with an oxygen permeability of less than approximately 0.4 cm3·mm/m2·atm·day.

5. A method for producing a surface mount device comprising:

providing a plurality of layers including a first layer that is B-staged and a second layer that defines an opening for receiving a core device;

inserting the core device in the opening defined by the second layer;

covering the second layer and the core device with the first layer that is B-staged;

placing a first metal layer under the plurality of layers and a second metal layer over the plurality of layers; and inserting the first metal layer, the second metal layer, and the plurality of layers in a vacuum-heat-press to cure the plurality of layers, thus curing the first layer and second layer until the first layer that is B-staged becomes C-staged, wherein the core device is substantially surrounded by an oxygen-barrier material with an oxygen permeability of less than approximately 0.4 cm3·mm/m2·atm·day.

6. A method for producing a surface mount device comprising:

providing a plurality of layers including a first layer that is B-staged and a second layer comprising a plurality of openings for receiving a plurality of core devices;

inserting the core device in the opening defined by the second layer;

covering the second layer and the core device with the first layer that is B-staged;

curing the first layer and second layer until the first layer that is B-staged becomes C-staged, wherein the core device is substantially surrounded by an oxygen-barrier material with an oxygen permeability of less than approximately 0.4 cm3·mm/m2·atm·day.

7. The method according to claim 6, further comprising:

cutting the plurality of layers after curing to produce a plurality of components.

8. The method according to claim 6, wherein properties of the core device deteriorate when exposed to oxygen for a period of time.

9. The method according to claim 6, wherein the core device is a positive-temperature-coefficient (PTC) device.

10. A method for producing a surface mount device comprising:

providing a substrate layer that includes a first contact pad and a second contact pad;

placing a core device in between (a) the first contact pad that is in electrical contact with a conductive clip, and (b) the second contact pad such that a bottom conductive surface of the core device is in electrical contact with the second contact pad and a top conductive surface of the core device is in electrical contact with the conductive clip;

injecting an A-staged material around the core device and the conductive clip; and curing the A-staged material until the A-staged material become C-staged material, wherein the core device is substantially surrounded by an oxygen-barrier material.

11. The method according to claim 10, further comprising forming the conductive clip integrally with the substrate.

12. The method according to claim 10, further comprising fastening the conductive clip over the second contact pad after the core device is placed on the first contact pad.

13. The method according to claim 10, wherein the injected A-staged material comprises an oxygen-barrier material.

14. The method according to claim 10, further comprising:

applying the core device with an oxygen-barrier material before fastening the core device on the first contact pad.

15. The method according to claim 10, wherein the core device is a positive-temperature-coefficient (PTC) device.

16. The method according to claim 1, further comprising: applying the core device with an oxygen-barrier material before fastening the core device on the component contact surface on the first substrate layer and the component contact surface on the second substrate layer.

17. The method according to claim 1, wherein the injected A-staged material comprises an oxygen-barrier material.

* * * * *